US006461198B1

(12) United States Patent
Chao

(10) Patent No.: US 6,461,198 B1
(45) Date of Patent: Oct. 8, 2002

(54) EARPHONE PLUG AND JACK WITH MULTIPLE CONTACT POINTS

(76) Inventor: Shu Mai Chao, No. 209, Sec. 2, Chung Chang Road, Hu Ko, Hsinchu Shien (TW)

( * ) Notice: Subject to any disclaimer, the term of this patent is extended or adjusted under 35 U.S.C. 154(b) by 0 days.

(21) Appl. No.: 09/572,334

(22) Filed: May 18, 2000

(51) Int. Cl.[7] ..... H01R 24/04
(52) U.S. Cl. ..... 439/668; 439/669
(58) Field of Search ..... 439/638, 668–669

(56) References Cited

U.S. PATENT DOCUMENTS 4,975,087 A * 12/1990 Williams et al. ..... 439/668
5,432,847 A * 7/1995 Hill et al. ..... 439/668
5,895,294 A * 4/1999 DeLangis et al. ..... 439/669
6,038,766 A * 3/2000 Werner ..... 439/668

* cited by examiner

*Primary Examiner*—Tho D. Ta
(74) *Attorney, Agent, or Firm*—Rosenberg, Klein & Lee

(57) ABSTRACT

An audio connection apparatus comprising plug and jack assemblies is provided. The jack assembly defines a primary insertion hole and at least a pair of secondary insertion openings disposed laterally therefrom. The jack assembly includes a plurality of first conductive plates disposed in each of the secondary insertion openings. The plug assembly which releasably couples to the jack assembly includes a central shaft for engaging the primary insertion hole of the jack assembly in electrically conductive manner, as well as at least a pair of secondary insertions disposed laterally from the central shaft for respectively engaging the insertion openings of the jack assembly in electrically conductive manner. Each secondary insertion includes a plurality of second conductive plates each configured to contact a first conductive plate in electrically conductive manner. The engagement of the secondary insertions and secondary insertion openings enables the auxiliary transmission of electrical audio signals for supplementing the transmission of electrical audio signals through the engagement of the central shaft and primary insertion hole.

2 Claims, 3 Drawing Sheets

EARPHONE PLUG AND JACK WITH MULTIPLE CONTACT POINTS

BACKGROUND OF THE INVENTION

Earphone plugs and jacks only delivered monophonic sound signals in an earlier stage due to a limitation in their structures. Later on, an improved structure was utilized to provide a few individual contact points on an earphone plug. These independent contact points in conjunction with a corresponding structure of an earphone jack provided a better signal delivery effect. However, due to the limitation in the length of a plug rod an earphone plug is currently at most divided into four segments, each of which provides an independent signal transmission. Facing a continual pursuit for the promotion of sound quality, such a prior art structure of an earphone plug and jack can not satisfy the consumers requirements. It is desirable to have some improvements to provide a better transmission effect. Referring to FIG. 1, an improved design of an earphone plug and jack is shown. In the structure, the central shaft of an earphone plug (1) is provided on two sides with a secondary insertion (12). Each secondary insertion (12) is further provided on a single side face with a metal plate (121). The metal plate (121) operates in association with a single resilient conductive plate (3) in a secondary opening (22) of the earphone jack to obtain more contact points between the plug and the jack. However, such a design still has room for further improvements.

In view of the above problems, the invention primarily provides an improved structure of an earphone plug and jack with multiple contact points, in which the earphone plug is provided with two or more secondary insertions that are operatively associated with a corresponding structure of a jack to enhance a signal transmission effect. Now the features and advantages of the invention will be described in detail with reference to the accompanying drawings.

BRIEF DESCRIPTION OF THE INVENTION

DETAILED DESCRIPTION OF THE INVENTION

Figure 1:
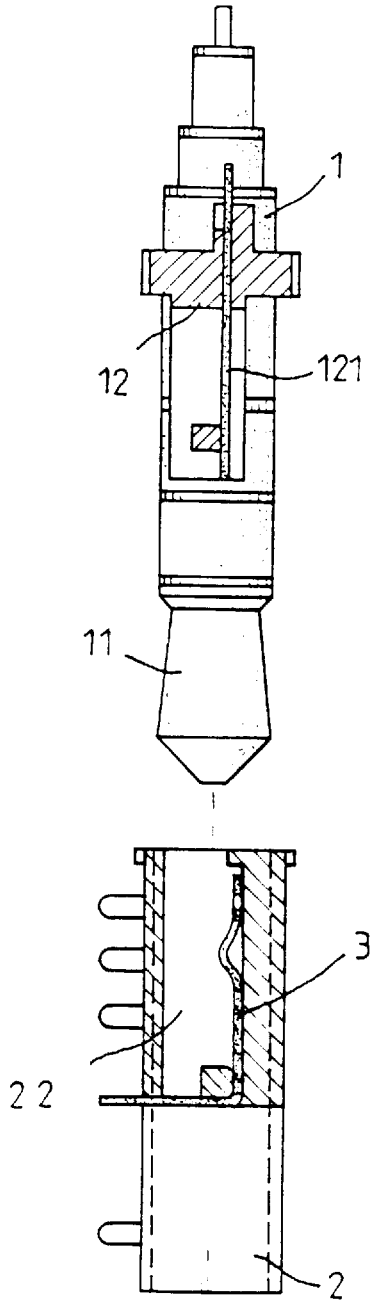
F I G. 1 (prior art)
FIG. 1 is a longitudinal cross sectional view of a prior art construction of an earphone plug and jack.
Figure 2:
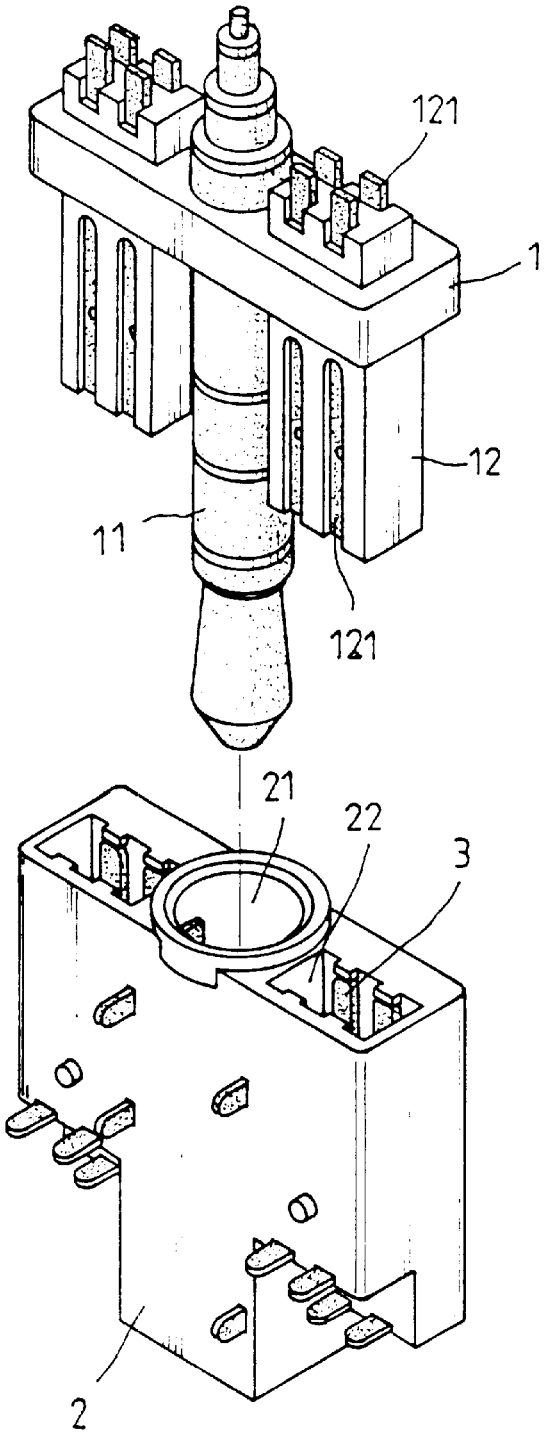
FIG. 2 is a perspective view showing the structure of an earphone plug and jack according to the invention.
Figure 3:
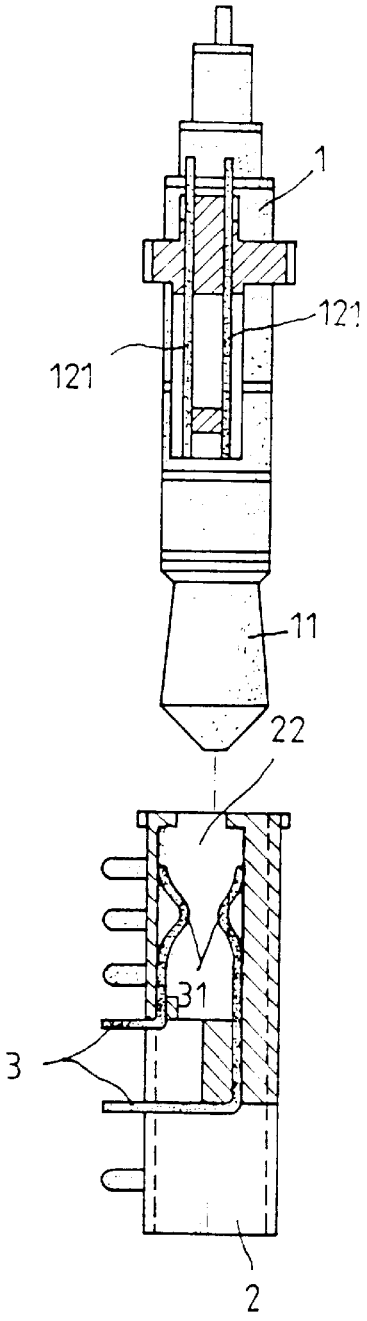
FIG. 3 is a longitudinal cross sectional view showing the earphone plug and jack of FIG. 2.
Figure 4:
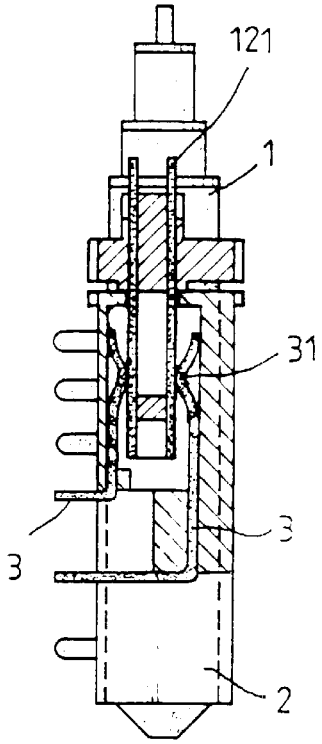
FIG. 4 is a longitudinal cross sectional view depicting the earphone plug and jack of FIG. 2 in an assembled state.

With reference to the accompanying drawings, the invention mainly comprises an earphone plug (1) and an earphone jack (2). The earphone plug (1) is provided with a central shaft (11) with a secondary insertion (12) on two sides thereof. The invention is featured by two or more metal plates (121) disposed on two sides of the secondary insertion (12). The earphone jack (2) is provided on the center with a round insertion hole (21) for accommodation of the central shaft (11) of an earphone plug (1). The earphone jack (2) is further provided with a secondary insertion opening (22) on each side thereof to receive a secondary insertion (12) of the earphone plug (1) of the invention. Furthermore, disposed in each secondary insertion opening (22) is a pair of opposed conductive plate (3) that has a curved contact portion (31).

In use, the curved contact portion (31) of each conductive plate (3) is in touch with one of the metal plates (121) disposed on two sides of a secondary insertion (12) to form an effective conductive connection after an earphone plug is inserted into a jack. With such an arrangement, this present invention can provide multiple contact points, which in turn enhances the conductive effect of sound signals and provides a wider sound range. Thus the invention can achieve a conductive effect that a conventional earphone device could never reach.

In summary, the invention primarily consists in an improvement made on the conductive connection between an earphone plug and an earphone jack, which can provide a better signal transmission and a superior sound quality. Evidently the invention is an advancement in art. It has the essences of a patent and so we hereby file an application for a patent grant.

What is claimed is:

1. An audio connection apparatus comprising:

(a) a jack assembly defining a primary insertion hole and at least a pair of secondary insertion openings disposed laterally offset therefrom, said jack assembly including at least one pair of mutually opposed first conductive plates disposed respectively along opposed sidewall portions formed about each said secondary insertion opening; and, (b) a plug assembly releasably coupled to said jack assembly, said plug assembly including:

(i) a central shaft defining a primary coupling member configured to engage said primary insertion hole of said jack assembly in electrically conductive manner; and, (ii) at least a pair of secondary insertions disposed laterally from said central shaft for respectively engaging said insertion openings of said jack assembly, each said secondary insertion including at least a pair of second conductive plates configured to extend in resiliently captured manner between one said pair of said first conductive plates, each said second conductive plate contacting one said first conductive plate in electrically conductive manner, at least one of said contacting first and second conductive plates defining a resiliently protrusive curved contact portion;

said engagement of said secondary insertions and said secondary insertion openings enabling the auxiliary transmission of electrical audio signals therethrough to supplement the transmission of electrical audio signals through said engagement of said central shaft and said primary insertion hole.

2. The audio connection apparatus as recited in claim, 1 wherein each said second conductive plate of said plug assembly defines a substantially planar contact surface, and each said first conductive plate of said jack assembly defines said resiliently protrusive curved contact portion.

* * * * *